US005882248A

United States Patent [19]

Wright et al.

[11] Patent Number: 5,882,248

[45] **Date of Patent: *Mar. 16, 1999**

[54] APPARATUS FOR SEPARATING WAFERS FROM POLISHING PADS USED IN CHEMICAL-MECHANICAL PLANARIZATION OF SEMICONDUCTOR WAFERS

[75] Inventors: David Q. Wright; Mike Walker; Karl M. Robinson, all of Boise, Id.

[73] Assignee: Micron Technology, Inc., Boise, Id.

[ * ] Notice: The term of this patent shall not extend beyond the expiration date of Pat. No. 5,658,190.

[21] Appl. No.: 910,693

[22] Filed: Aug. 13, 1997

Related U.S. Application Data

[63] Continuation of Ser. No. 573,430, Dec. 15, 1995, Pat. No. 5,658,190.

[51] Int. Cl.[6] ..... B24B 5/00

[52] U.S. Cl. ..... 451/285; 451/286; 451/287; 451/288; 451/289; 451/921; 451/388

[58] Field of Search ..... 451/285, 289, 451/921, 388

[56] References Cited

U.S. PATENT DOCUMENTS 5,081,796 1/1992 Schultz ..... 451/8
5,658,190 8/1997 Wright et al. ..... 451/287

*Primary Examiner*—Robert A. Rose
*Assistant Examiner*—George Nguyen
*Attorney, Agent, or Firm*—Seed and Berry, LLP

[57] ABSTRACT

The present invention is a planarizing machine for use in chemical-mechanical planarization of semiconductor wafers that has a moveable platen, a polishing pad, a wafer carrier, and a wafer separator. The polishing pad is positioned on the platen, and it has a planarizing surface with an operational zone upon which the wafer may be planarized. The wafer carrier holds a wafer and is positionable opposite the polishing pad to engage the wafer with the operational zone of the polishing pad. The wafer separator engages either the polishing pad, the wafer, or the wafer carrier to urge a portion of the wafer away from the pad.

27 Claims, 7 Drawing Sheets

APPARATUS FOR SEPARATING WAFERS FROM POLISHING PADS USED IN CHEMICAL-MECHANICAL PLANARIZATION OF SEMICONDUCTOR WAFERS

CROSS-REFERENCE TO RELATED APPLICATION

This application is a continuation application of U.S. patent application Ser. No. 08/573,430, filed Dec. 15, 1995, and issued as U.S. Pat. No. 5,658,190 on Aug. 19, 1997.

TECHNICAL FIELD

The present invention relates to chemical-mechanical planarization of semiconductor wafers, and more specifically to a planarizing machine with a separator for separating a planarized wafer from a polishing pad.

BACKGROUND OF THE INVENTION

Chemical-mechanical planarization ("CMP") processes are frequently used to planarize the surface layer of a wafer in the production of ultra-high density integrated circuits. In a typical CMP process, a planarizing surface on a polishing pad is covered with a slurry solution containing small, abrasive particles and reactive chemicals. A wafer is mounted in a wafer holder, and the wafer holder is positioned opposite the polishing pad. The wafer and/or the polishing pad are then moved relative to one another allowing the abrasive particles in the slurry to mechanically remove the surface of the wafer, and the reactive chemicals in the slurry to chemically remove the surface of the wafer.

CMP processes must consistently and accurately planarize a uniform, planar surface on the wafer at a desired end-point. Many microelectronic devices are typically fabricated on a single wafer by depositing layers of various materials on the wafer, and manipulating the wafer and the other layers of material with photolithographic, etching, and doping processes. In order to manufacture ultra-high density integrated circuits, CMP processes must provide a highly planar surface so that the geometries of the component parts of the circuits may be accurately positioned across the full surface of the wafer. Integrated circuits are generally patterned on a wafer by optically or electromagnetically focusing a circuit pattern on the surface of the wafer. If the surface of the wafer is not highly planar, the circuit pattern may not be sufficiently focused in some areas, resulting in defective devices. Therefore, it is important to consistently and accurately create a uniformly planar surface on the wafer.

Several factors influence the uniformity of a planarized surface of a wafer, one of which is the distribution of the slurry between the polishing pad and the wafer. A uniform distribution of slurry between the pad and the wafer results in a more uniform surface on the wafer because the abrasive particles and the chemicals in the slurry will react more evenly across the whole wafer. One type of polishing pad provides a number of wells in the pad substrate that are uniformly spaced apart from one another across the surface of the pad. Each well holds a volume of slurry, and as the pad passes across the surface of the wafer, the slurry is drawn out of the wells into the space between the wafer and the pad. As the slurry is drawn out of the wells, a vacuum is created in the wells that holds the wafer next to the planarizing surface of the pad.

CMP processes must also provide a high throughput of finished devices to lower the unit cost of each device. The wafers, therefore, are generally between six inches and eight inches in diameter so that hundreds of microelectronic devices may be simultaneously fabricated on a single wafer. When six to eight inch diameter wafers are planarized in the presence of a slurry, however, a significant surface tension exists between the wafer, slurry, and polishing pad that holds the wafers next to the polishing pad.

One problem with current CMP planarizers is that after the CMP process is finished, it is difficult to remove large wafers from conventional polishing pads, or any wafer from polishing pads with slurry wells. Wafers are attached to the wafer carrier by drawing a vacuum on the backside of the wafer that is low enough to prevent the wafer from being damaged. After planarizing, wafers are conventionally removed from polishing pads by simply lifting the wafer carrier. Such a low vacuum, however, generally does not provide enough force to overcome the surface bond between large wafers and the polishing pads. Similarly, such low vacuums are also insufficient to overcome the bond between wafers and polishing pads with slurry wells. Therefore, it would be desirable to develop a CMP machine that can separate virtually any type of wafer from any type of polishing pad.

SUMMARY OF THE INVENTION

The inventive machine is a planarizer for use in chemical-mechanical planarization of semiconductor wafers that has a moveable platen, a polishing pad, a wafer carrier, and a wafer separator. The polishing pad is positioned on the platen, and it has a planarizing surface with an operational zone upon which the wafer may be planarized. The wafer carrier holds a wafer, and it is positionable opposite the polishing pad to engage the wafer with the operational zone of the polishing pad. The wafer separator engages either the polishing pad, the wafer, or the wafer carrier to lift a portion of the wafer away from the pad.

In an inventive method for chemical-mechanical planarization of a semiconductor wafer, the wafer is held by a wafer carrier and pressed against the polishing pad in the presence of a slurry. At least one of the wafer or the polishing pad is moved with respect to the other to remove material from the surface of the wafer. After a desired amount of material is removed from the surface of the wafer, a portion of the wafer is separated from the pad to break a surface bond between the wafer and the polishing pad.

DETAILED DESCRIPTION OF THE INVENTION

The present invention provides a chemical-mechanical planarization machine that can separate virtually any type of wafer from any type of polishing pad after the wafer has been planarized. Conventional chemical-mechanical planarization machines typically cannot remove large wafers from polishing pads, or most any type of wafer from pads with slurry wells, because the vacuum on the backside of the wafer is insufficient to break the bond between such wafers and polishing pads. The present invention provides a wafer separator that acts against only a portion of the wafer, and preferably only a peripheral portion of the wafer. By acting against only a portion of the wafer instead of the whole surface area, a relatively small force can separate the wafer from the polishing pad. The present invention is described in detail in FIGS. 1–8, in which like reference numbers refer to like parts throughout the various figures.

Figure 1:
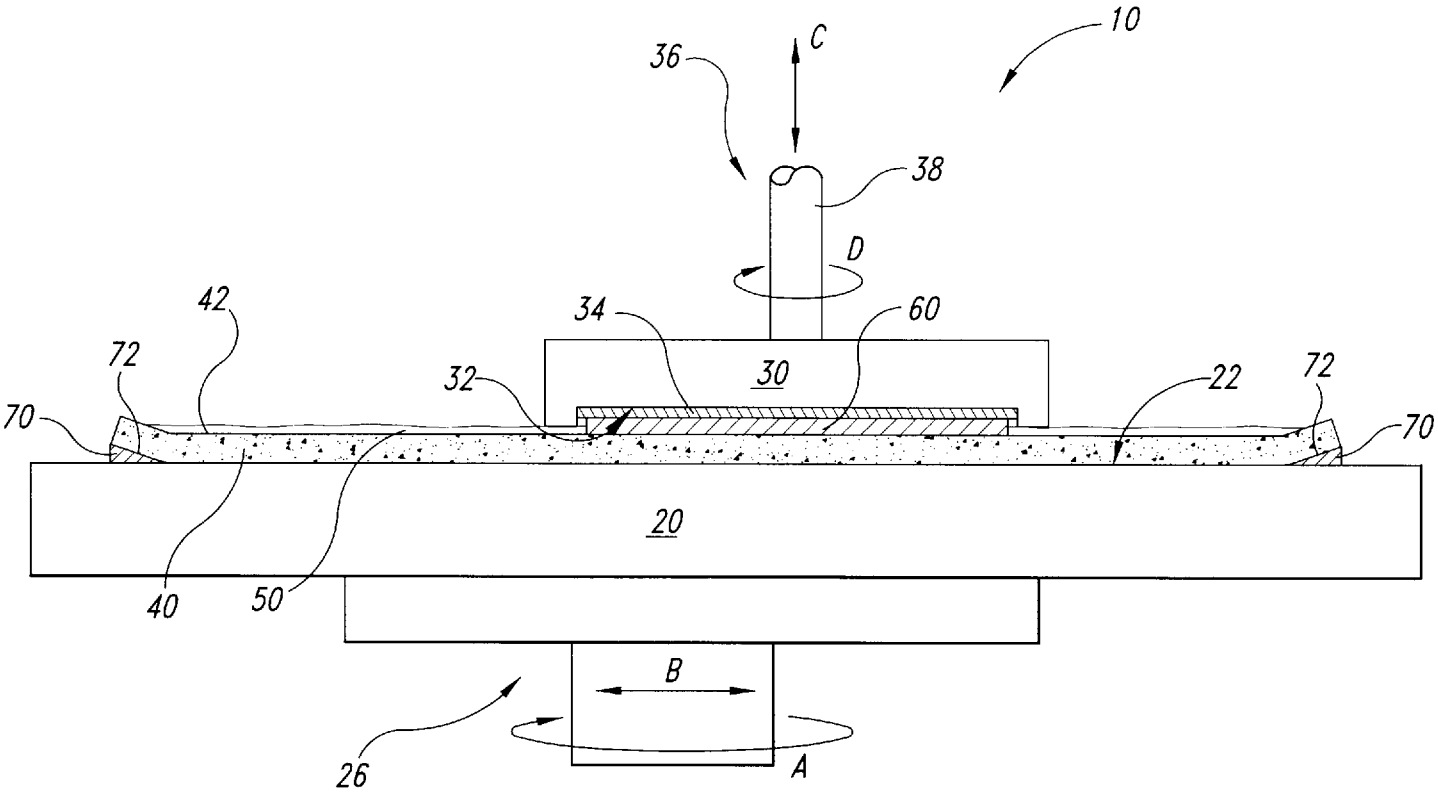
FIG. 1 is a schematic cross-sectional view of a chemical-mechanical planarization machine in accordance with the invention.
Figure 2:
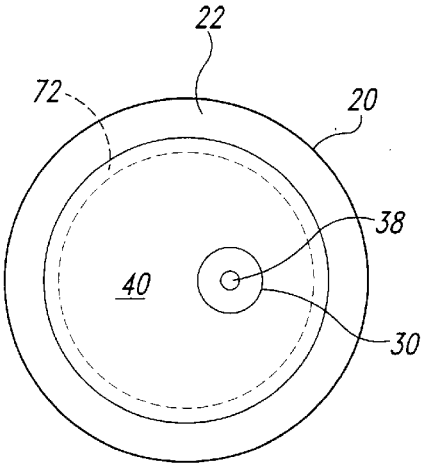
FIG. 2 is a top elevational view of a chemical-mechanical planarization machine in accordance with the invention.

FIGS. 1 and 2 illustrate a chemical-mechanical planarization machine 10 with a platen 20, a wafer carrier 30, a polishing pad 40, and a wafer separator 70. The platen 20 has a top surface 22 upon which the polishing pad 40 is positioned. A drive assembly 26 rotates the platen 20 as indicated by arrow A, and/or reciprocates the platen 20 back and forth as indicated by arrow B. The motion of the platen 20 is imparted to the pad 40 because the polishing pad 40 is adhered to the top surface 22 of the platen 20.

The wafer carrier 30 has a lower surface 32 to which a wafer 60 may be attached by drawing a vacuum on the backside of the wafer. A resilient pad 34 may be positioned between the wafer 60 and the lower surface 32 to enhance the connection between the wafer 60 and the wafer carrier 30. The wafer carrier 30 may have an actuator assembly 36 attached to it for imparting axial and/or rotational motion as indicated by arrows C and D, respectively. The actuator assembly 36 is generally attached to the wafer carrier 30 by a gimbal joint that allows the wafer carrier 30 to pivot freely about the three orthogonal axes centered at the end of the actuator 36.

Several embodiments of a planarizer with a wafer separator are within the scope of the invention. In one series of embodiments, the wafer separator 70 is positioned towards the perimeter of the pad, and it has a contact surface 72 that engages either the pad 40, the wafer 60, or the wafer carrier 30. The wafer separator 70 may be passive, in which a peripheral portion of the wafer 60 is urged away from the pad 40 by positioning the pad 40 on the wafer separator 70, or moving the wafer 60 and/or the wafer carrier 30 against the wafer separator 70. Alternatively, the wafer separator 70 may be active, in which the wafer separator 70 is moved against one of the pad 40, the wafer 60, or the wafer carrier 30 to separate the wafer 60 from the pad 40. The wafer separator 70 has many configurations, including a ring (shown in FIG. 2) that has an upper surface that defines the contact surface 72. The wafer separator 70 may alternatively be a number of tapered segments (not shown) positioned about the perimeter of the pad 40. The ring may have a wedge-shaped cross-section, a semi-circular shaped cross-section, a semi-elliptical cross-section, or any other suitable cross-section that provides an inclined contact surface that lifts a portion of the wafer 60 from the pad 40. The wafer separator 70 may be positioned on the pad, the platen, or separately from the pad and platen.

In the embodiment of the invention illustrated in FIGS. 1 and 2, the wafer separator 70 is a ring-like ridge positioned on the top surface 22 of the platen 20 towards the perimeter of the platen 20. The wafer separator 70 has a wedge-shaped cross-section with an upper surface 72 that defines the contact surface. The perimeter of the pad 40 is positioned on the contact surface 72 to form a non-planar section 43 on the pad 40.

Figure 3:
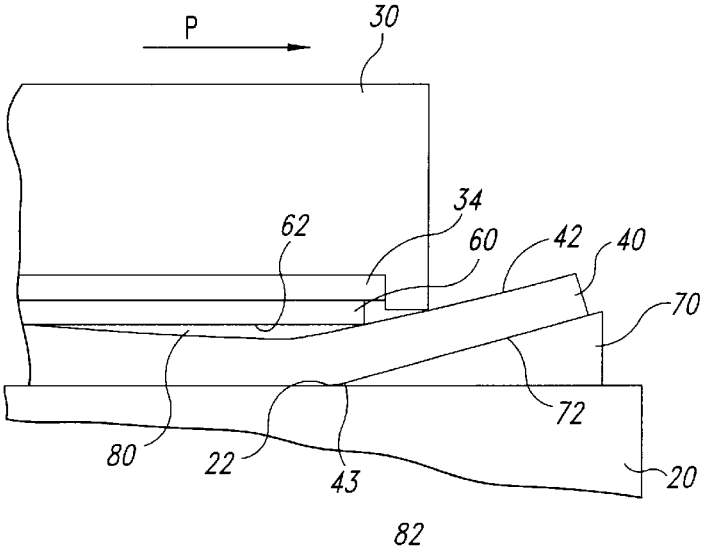
FIG. 3 is a partial cross-sectional view of the chemical-mechanical planarization machine of FIG. 1.

FIG. 3 shows the operation of the embodiment of the wafer separator 70 illustrated in FIGS. 1 and 2. The wafer 60 is substantially rigid and cannot conform to the non-planar section 43 of the pad 40. Thus, when the wafer 60 is brought over to the non-planar section 43, a peripheral portion of the bottom surface 62 of the wafer 60 is pried away from the upper surface 42 of the pad 40 to form a gap 80. Once the gap 80 is formed, the wafer 60 can be fully separated from the pad 40 by lifting the wafer carrier 30 upwardly in the direction of arrow C (shown in FIG. 1).

Figure 5:
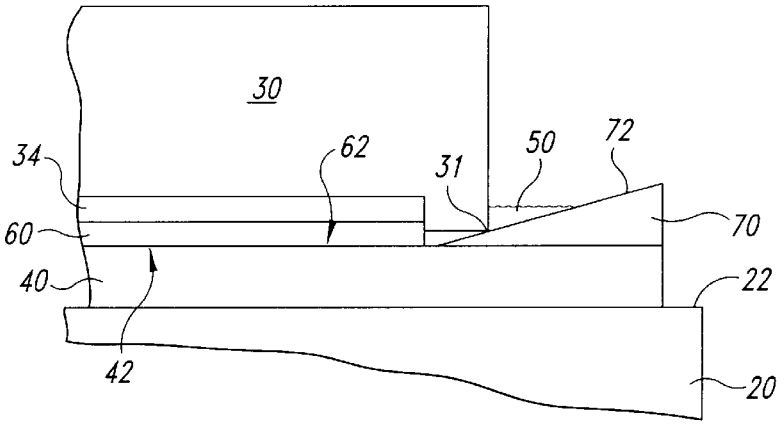
FIG. 5 is a partial cross-sectional view of the chemical-mechanical planarization machine of FIG. 4.
Figure 4:
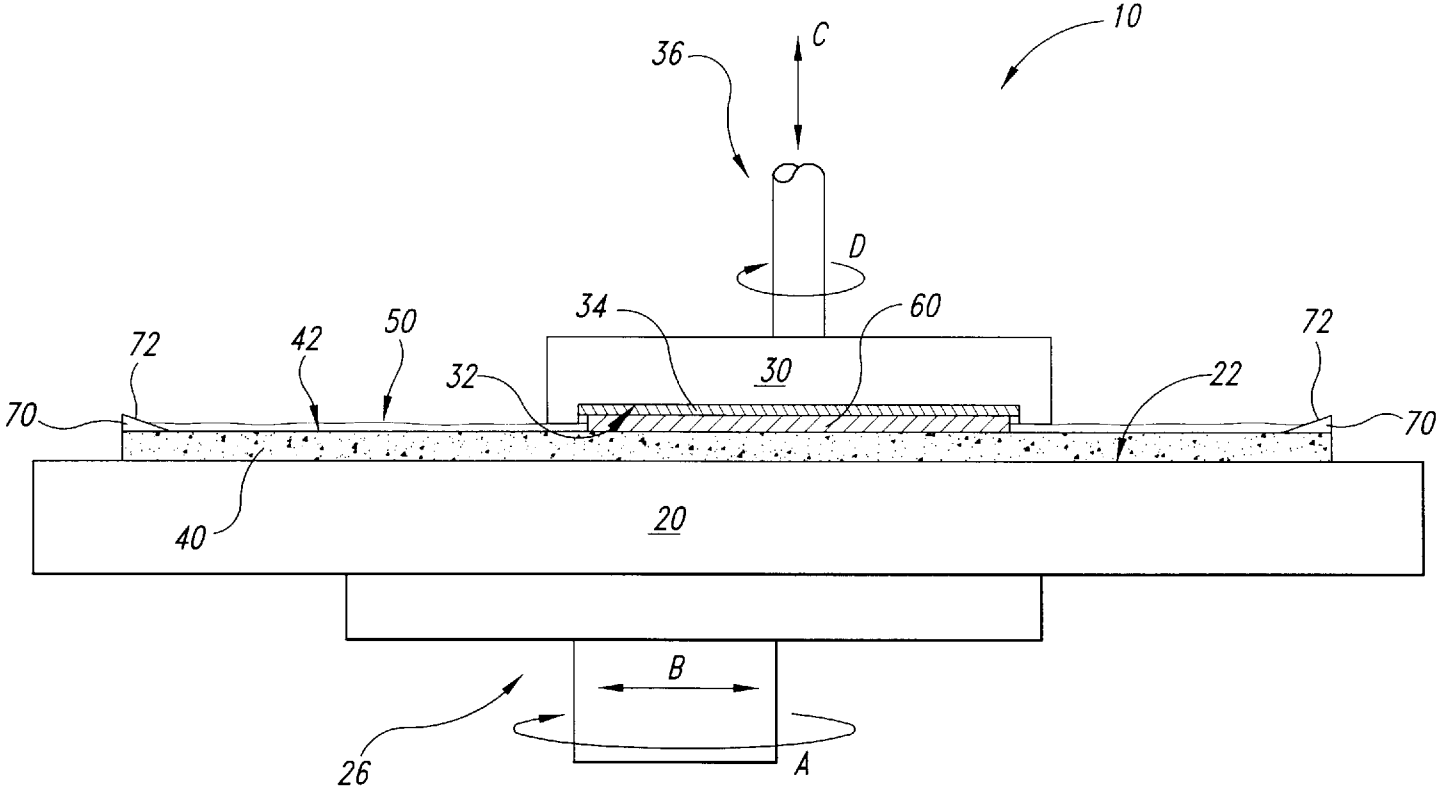
FIG. 4 is a schematic cross-sectional view of another chemical-mechanical planarization machine in accordance with the invention.

FIG. 4 illustrates another embodiment of the invention, in which the wafer separator 70 is positioned on the upper surface 42 of the polishing pad 40. The wafer separator 70 is positioned towards the perimeter of the polishing pad 40 so that it is outside of an operational zone on the pad where the wafer 60 is planarized. In operation, the wafer carrier 30 and wafer 60 are moved across the pad until at least one of them engages the wafer separator. Referring to FIG. 5, the contact surface 72 engages either a forward edge 31 of the wafer carrier 30 (shown by FIG. 5), or a peripheral portion of the wafer 60 itself (not shown). As the forward edge 31 of the wafer carrier 30 rides up over the contact surface 72 of the wafer separator 70, the peripheral portion of the wafer 60 proximate to the forward edge 31 is lifted away from the pad 40. When the wafer separator 70 engages the wafer 60 (not shown), the peripheral portion of the wafer 60 proximate to the wafer separator 70 is pried from pad 40. Thus, the wafer separator 70 allows the wafer 60 to be easily removed from the pad 40.

Figure 6:
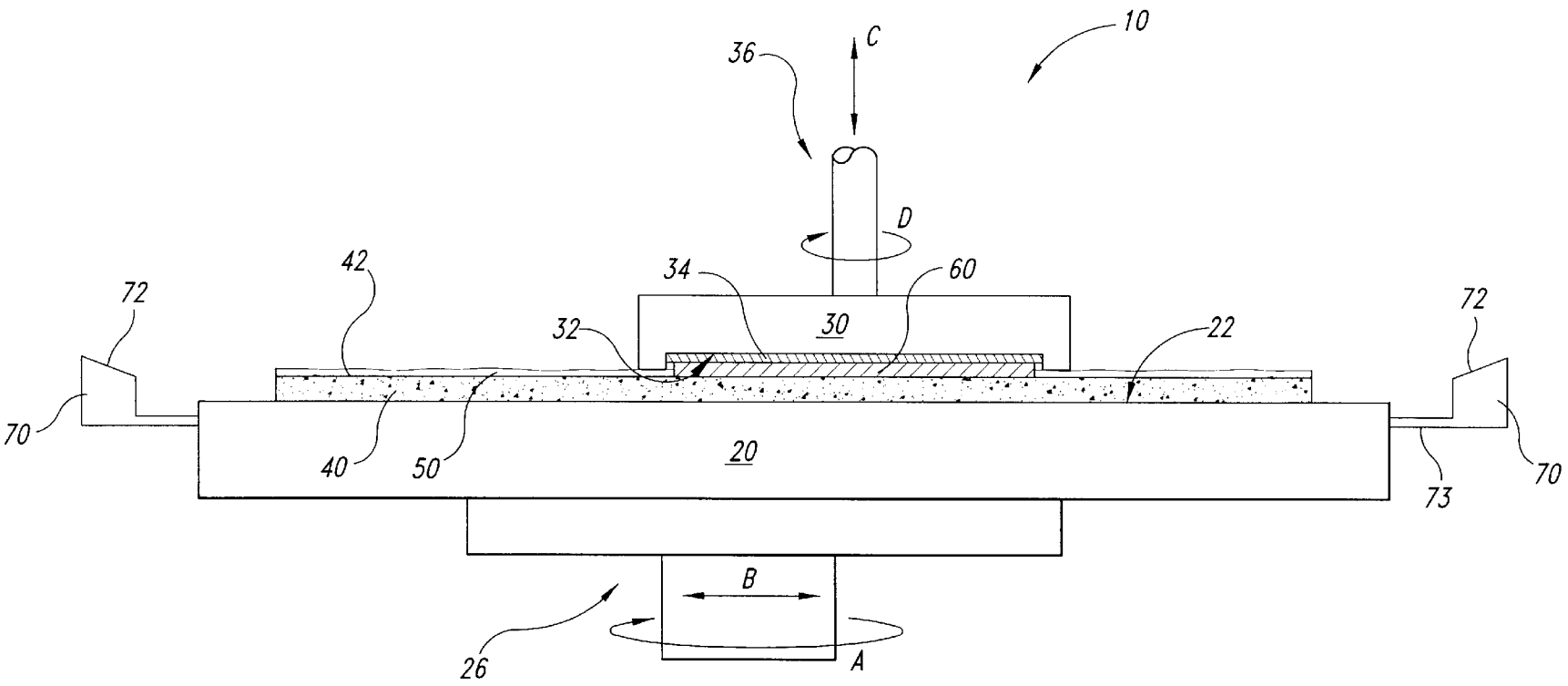
FIG. 6 is a schematic cross-sectional view of another chemical-mechanical planarization machine in accordance with the invention.
Figure 7:
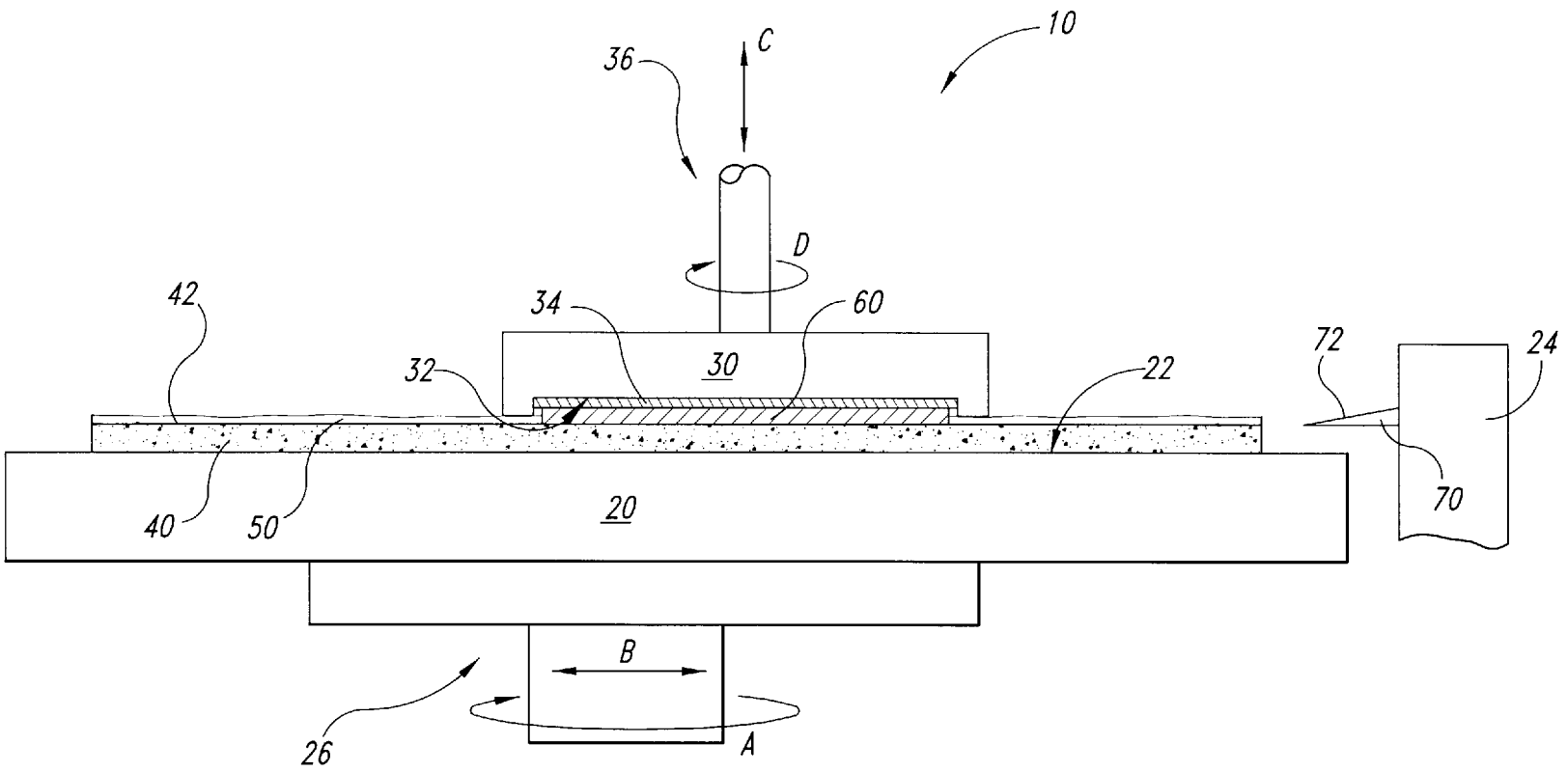
FIG. 7 is a schematic cross-sectional view of another chemical-mechanical planarization machine in accordance with the invention.

FIGS. 6 and 7 illustrate additional embodiments of the invention in which the wafer separator 70 is positioned radially outwardly from the perimeter of the platen 20. In FIG. 6, the wafer separator 70 is attached to the platen 20 by an arm 73. While in FIG. 7, the wafer separator 70 is attached to a wall 24 of the planarizer 10. As with the embodiments discussed above with respect to FIGS. 1–5, the wafer separators 70 illustrated in FIGS. 6 and 7 operate by separating a peripheral portion of the wafer 60 from the pad 40. The wafer separators 70 shown in FIGS. 6 and 7 are attached to the platen 20 and the wall 24, respectively, at an elevation that aligns the contact surface 72 with either the wafer 60 or the wafer carrier 30.

FIGS. 1–7 illustrate a passive wafer separator 70 that operates by positioning the pad 40 on the contact surface 72 of the wafer separator 70, or by moving the wafer 60 and the wafer carrier 30 to engage the contact surface 72. In related embodiments (not shown), the wafer separator 70 may be active such that it can be moved to engage the appropriate item on the planarizer. For instance, a wafer separator 70 may be attached to an actuator (not shown) that is connected to the wall 24 (shown in FIG. 7) of the planarizer 10. The actuator may be extended radially inwardly towards the center of the platen 20 to engage the wafer separator 70 with either the pad 40, the wafer 60, or the wafer carrier 30. The present invention, therefore, is not limited to passive wafer separators.

Figure 8A:
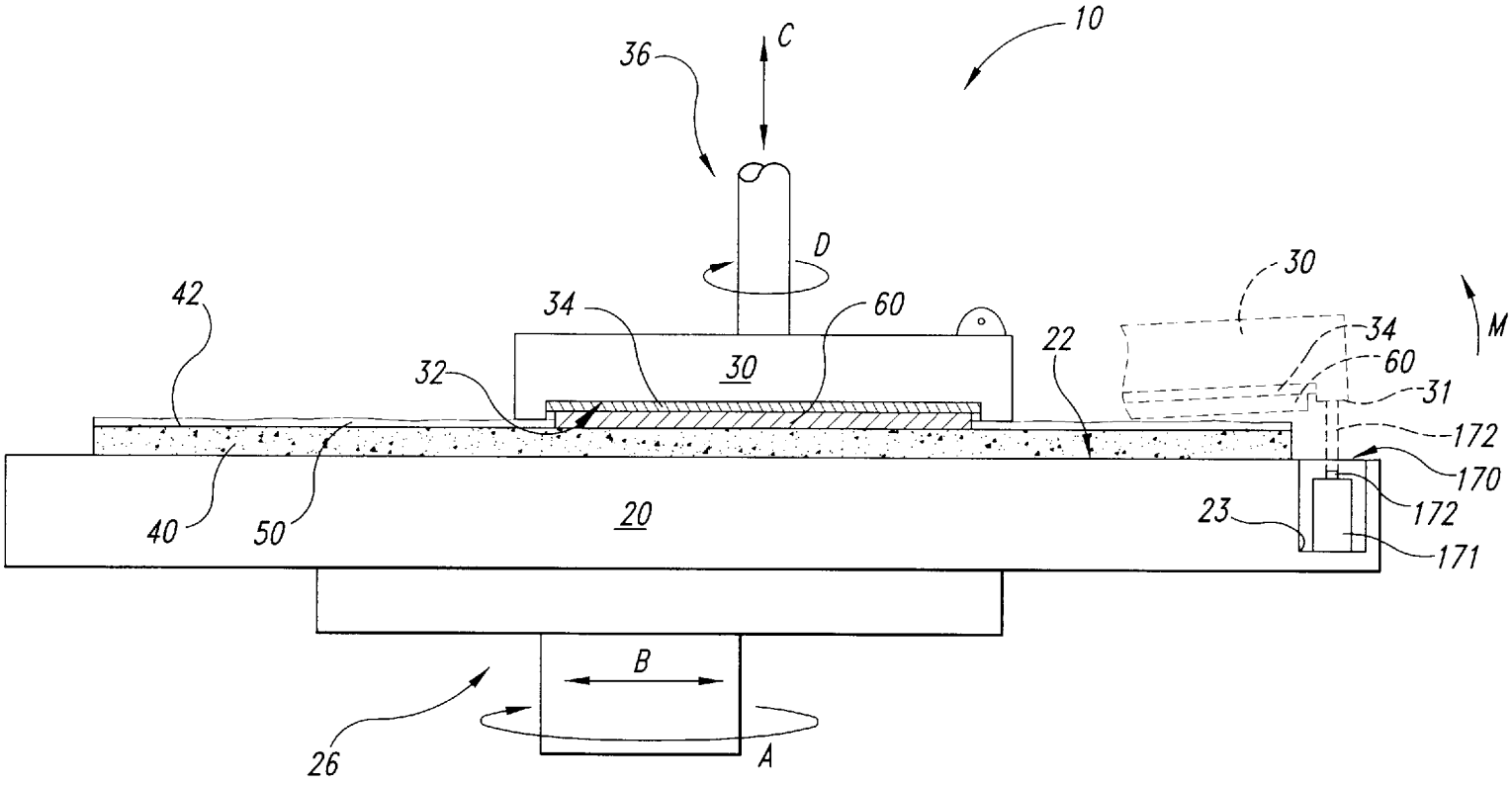
FIG. 8A is a schematic cross-sectional view of another chemical-mechanical planarization machine in accordance with the invention.
Figure 8B:
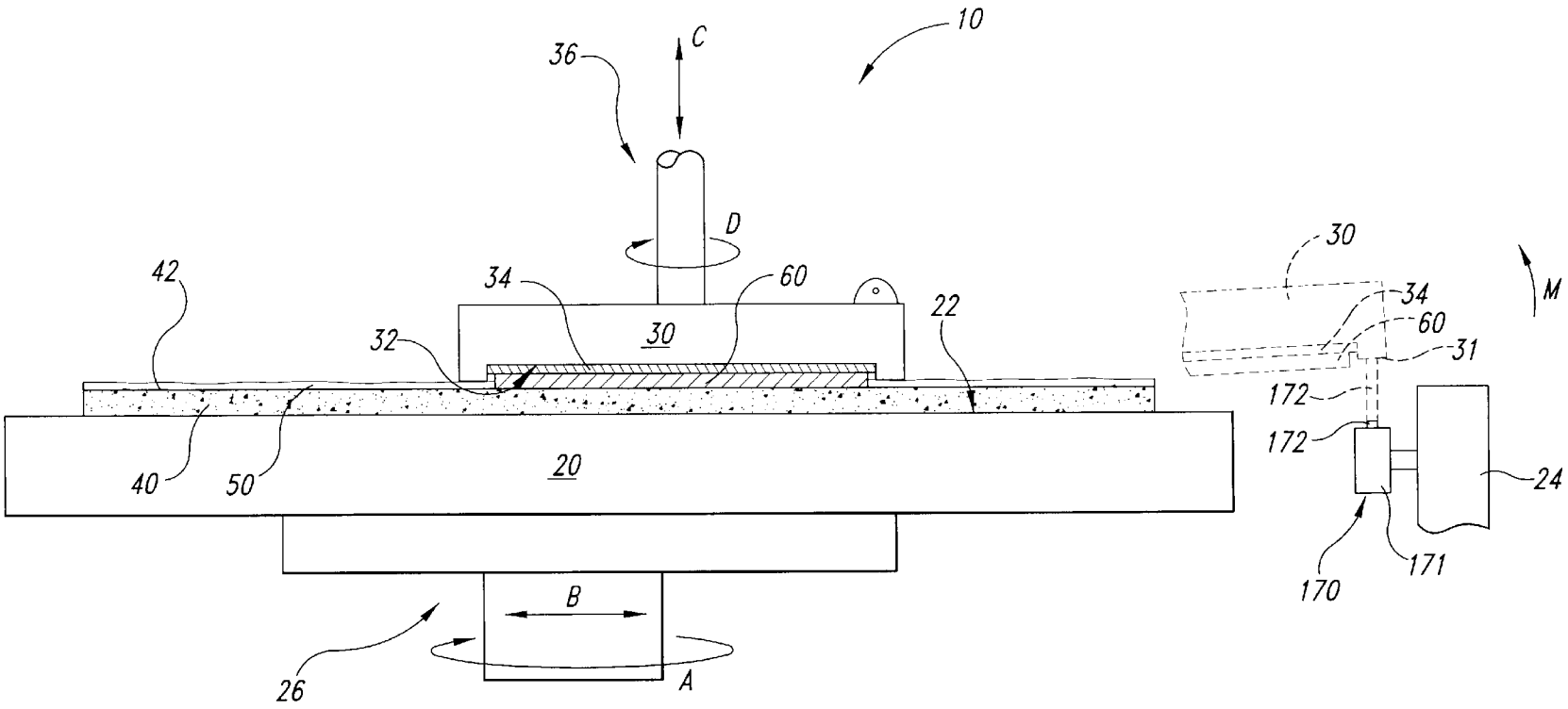
FIG. 8B is a schematic cross-sectional view of another chemical-mechanical planarization machine in accordance with the invention.

FIG. 8A illustrates another type of active wafer separator 170. The active wafer separator 170 is a piston 171 with an extensible rod 172. The piston 171 is positioned in a hole 23 towards the perimeter of the platen 20. In operation, the wafer carrier 30 and wafer 60 are translated across the surface of the pad 40 until the front edge 31 of the wafer carrier 30 is positioned over the rod 172. The rod 172 is then engaged with the wafer carrier 30, and the wafer carrier 30 and wafer 60 are lifted from the pad 40. FIG. 8B shows another embodiment in which the active wafer separator 170 is attached to the wall 24 of the planarizer 10. In this embodiment, the wafer carrier 30 and wafer 60 are translated across the surface of the pad 40 and over the peripheral edge of the platen 20. In still another embodiment (not shown), the hole 23 may be positioned at or near the center of the pad 40 so that a central portion of the pad may be deformed upwardly to separate any portion of the wafer from the pad. Thus, the present invention covers separating any portion of the wafer from the pad.

One advantage of the present invention is that it provides a chemical-mechanical planarizer 10 with a wafer separator that separates virtually any type of wafer from any type of polishing pad. The present invention is particularly useful in connection with larger wafers having diameters between 6 and 8 inches, and polishing pads with slurry wells. The present invention, however, is not limited to such particular uses and may be useful for smaller wafers as well.

While the detailed description above has been expressed in terms of specific examples, those skilled in the art will appreciate that many other structures could be used to accomplish the purpose of the disclosed procedure. Accordingly, it can be appreciated that various modifications of the above-described embodiment may be made without departing from the spirit and scope of the invention. Therefore, the spirit and scope of the present invention are to be limited only by the following claims.

We claim:

1. A planarizer for use in chemical-mechanical planarization of a semiconductor wafer, comprising:

a moveable platen;

a polishing pad positioned on the moveable platen, the pad having a planarizing surface with an operational zone for planarization of the wafer;

a wafer carrier positioned opposite the polishing pad, the wafer being attachable to the wafer carrier and engageable with the operational zone of the polishing pad; and a wafer separator having an inclined surface and a bottom surface, the bottom surface of the wafer separator being attached to one of the platen under an edge portion of the pad or the planarizing surface of the polishing pad at the edge portion, and the inclined surface extending upwardly and radially outwardly from the bottom surface to separate a portion of the wafer from the planarizing surface as the wafer passes over the portion of the pad.

2. The planarizer of claim 1 wherein the wafer separator is positioned towards the perimeter of the pad and has a contact surface engageable with at least one of the pad, the wafer, and the wafer carrier.

3. The planarizer of claim 1 wherein the wafer separator is a ridge positioned proximate to the perimeter of the platen, the ridge having an upper surface that defines the contact surface.

4. The planarized of claim 3 wherein the ridge is positioned on a top surface of the platen.

5. The planarizer of claim 3 wherein the ridge is ring with a wedge-shaped cross-section.

6. The planarizer of claim 3 wherein the ridge is a tapered segment with a wedge-shaped cross-section.

7. The planarizer of claim 3 wherein the ridge is positioned on the planarizing surface of the polishing pad outside of the operational zone.

8. A planarizer for use in chemical-mechanical planarization of a semiconductor wafer, comprising:

a polishing pad positioned on a moveable platen, the pad having a planarizing surface with an operational zone for planarization of the wafer;

a wafer carrier positioned opposite the polishing pad, the wafer being attachable to the wafer carrier and engageable with the operational zone of the polishing pad; and a wafer separator for urging a peripheral portion of the wafer away from the pad to break a surface bond between the pad and the wafer, the wafer separator being positioned on one of the platen under an edge portion of the pad or on top of the planarizing surface of an edge portion of the pad.

9. The planarizer of claim 8 wherein the wafer separator is positioned towards the perimeter of the pad and has a contact surface engageable with at least one of the pad, the wafer, and the wafer carrier.

10. The planarizer of claim 9 wherein the wafer separator is a ridge positioned proximate to the perimeter of the platen, the ridge having an upper surface that defines the contact surface.

11. A method for chemical-mechanical planarization of a semiconductor wafer, comprising;

pressing the wafer against a polishing pad in the presence of a slurry, the wafer being held by a wafer carrier;

moving at least one of the wafer or the polishing pad with respect to the other to remove material from the wafer; and engaging at least one of the pad, the wafer and the wafer carrier with a contact surface of a wafer separator that lifts a peripheral portion of the wafer away from the pad after removing material from the wafer.

12. A planarizer for use in chemical-mechanical planarization of a microelectronic substrate, comprising:

a moveable platen;

a polishing pad positioned on the moveable platen, the pad having a planarizing surface with an operational zone for planarization of the substrate;

a carrier positioned opposite the polishing pad, the substrate being attachable to the carrier and engageable with the operational zone of the polishing pad; and a ridge positioned on the platen under a portion of the polishing pad outside of the operational zone, the ridge having a contact face engaging the polishing pad to lift a portion of the polishing pad away from the platen so that the substrate is urged away from the planarizing surface when the carrier moves the substrate over the ridge.

13. The planarizer of claim 12 wherein the ridge comprises a ring removably attached to the platen.

14. The planarizer of claim 12 wherein the ridge comprises an arcuate segment lifting only a portion of the polishing pad away from the platen.

15. The planarizer of claim 12 wherein the ridge comprises a ring with a wedge-shaped cross-section along a radius of the ring.

16. The planarizer of claim 12 wherein the contact face is inclined upwardly and radially outwardly from the platen.

17. A planarizer for use in chemical-mechanical planarization of a microelectronic substrate, comprising:

a moveable platen;

a polishing pad positioned on the moveable platen, the pad having a planarizing surface with an operational zone for planarization of the substrate;

a carrier positioned opposite the polishing pad, the substrate being attachable to the carrier and engageable with the operational zone of the polishing pad; and a ridge positioned on the planarizing surface outside of the operational zone, the ridge having a contact face extending gradually upwardly from the planarizing surface of the pad so that the substrate is urged away from the planarizing surface when the carrier moves the substrate over the ridge.

18. The planarizer of claim 17 wherein the ridge comprises a continuous ring positioned adjacent to a perimeter portion of the polishing pad.

19. The planarizer of claim 17 wherein the ridge comprises a segment of a ring positioned adjacent to a perimeter portion of the polishing pad.

20. The planarizer of claim 17 wherein the ridge comprises a ring positioned adjacent to a perimeter portion of the polishing pad, the ring having a wedge-shaped cross-section along a radius.

21. The planarizer of claim 17 wherein the contact face is inclined upwardly and radially outwardly from the planarizing surface.

22. A method of planarizing a microelectronic substrate, comprising:

pressing the substrate against an operational zone of a planarizing surface of a polishing pad;

moving at least one of the substrate or the planarizing surface with respect to the other as the substrate is pressed against the operational zone;

subsequently holding the planarizing surface stationary; and positioning a portion of the substrate over a separator located outside of the operational zone on the planarizing surface, the separator causing the portion of the substrate to lift with respect to the operational zone of the planarizing surface.

23. The method of claim 22 wherein positioning a portion of the substrate over the separator comprises translating the substrate across the planarizing surface outside of the operational zone until an edge of the substrate engages an inclined a contact face of the separator.

24. The method of claim 22 wherein positioning a portion of the substrate over the separator comprises translating a carrier to which the substrate is attached over the polishing pad until an edge of the carrier engages an inclined face of the separator.

25. A method of planarizing a microelectronic substrate, comprising:

pressing the substrate against an operational zone of a planarizing surface of a polishing pad;

moving at least one of the substrate or the planarizing surface with respect to the other as the substrate is pressed against the operational zone; and positioning a portion of the substrate over a separator located on the platen outside of the operational zone and under the polishing pad, the separator causing the portion of the polishing pad to lift with respect to the operational zone of the planarizing surface so that the portion of the substrate disengages the planarizing surface as the substrate is positioned over the separator.

26. The method of claim 25 wherein positioning a portion of the substrate over the separator comprises translating the substrate across the planarizing surface outside of the operational zone until an edge of the substrate engages the lifted portion of the polishing pad.

27. The method of claim 25 wherein positioning a portion of the substrate over the separator comprises translating a carrier to which the substrate is attached over the polishing pad until an edge of the carrier engages the lifted portion of the polishing pad.

* * * * *